US009993868B2

(12) United States Patent
Erhard et al.

(10) Patent No.: US 9,993,868 B2
(45) Date of Patent: Jun. 12, 2018

(54) CONTROL DEVICE FOR THE ADVANCING MOTION OF A CASTING PLUNGER

(71) Applicant: Oskar Frech GmbH + Co. KG, Schorndorf (DE)

(72) Inventors: Norbert Erhard, Lorch (DE); Peter Maurer, Nuremberg (DE)

(73) Assignee: Oskar Frech GmbH + Co. KG, Schorndorf (DE)

( * ) Notice: Subject to any disclaimer, the term of this patent is extended or adjusted under 35 U.S.C. 154(b) by 588 days.

(21) Appl. No.: 14/372,423

(22) PCT Filed: Jan. 10, 2013

(86) PCT No.: PCT/EP2013/050377
§ 371 (c)(1),
(2) Date: Jul. 15, 2014

(87) PCT Pub. No.: WO2013/107682
PCT Pub. Date: Jul. 25, 2013

(65) Prior Publication Data

US 2015/0000856 A1 Jan. 1, 2015

(30) Foreign Application Priority Data

Jan. 16, 2012 (DE) ..... 10 2012 200 568

(51) Int. Cl.
*B22D 17/32* (2006.01)
*B22D 17/08* (2006.01)
(Continued)

(52) U.S. Cl.
CPC ..... *B22D 17/32* (2013.01); *B22D 17/08* (2013.01); *B22D 17/10* (2013.01); *B22D 17/2015* (2013.01)

(58) Field of Classification Search
CPC .... B22D 17/2015; B22D 17/32; B22D 17/10; B22D 17/08; B22D 46/00
See application file for complete search history.

(56) References Cited

U.S. PATENT DOCUMENTS 3,964,537 A * 6/1976 Koch ..... B22D 17/32 164/136
4,586,560 A 5/1986 Ikeya et al.
(Continued)

FOREIGN PATENT DOCUMENTS

CN 101239377 A 8/2008
DE 41 12 753 A1 10/1992
(Continued)

OTHER PUBLICATIONS

Corresponding International Search Report dated Feb. 20, 2014 with English Translation (four (4) pages).

*Primary Examiner* — Kevin P Kerns
*Assistant Examiner* — Steven S Ha
(74) *Attorney, Agent, or Firm* — Crowell & Moring LLP

(57) ABSTRACT

A device is provided for controlling the advancing movement of a casting plunger in a casting chamber of a cold-chamber die casting machine by way of an actuating signal, the advancing movement comprising a chamber filling movement phase from a partial filling position, with a partially filled casting chamber starting volume, to a full filling position, with a filled casting chamber remaining volume. In the device, a respective associated progression of an actuating signal is provided for different specified sets of values of a plurality of process parameters that influence the movement of the molten material in the casting chamber during the chamber filling movement phase, which progression is defined as the most suitable actuating signal progression for the particular set of parameter values. The device is designed to use the most suitable actuating signal progres-
(Continued)

sion in dependence on values of the process parameters pertaining at the beginning of a casting cycle for controlling the casting plunger advancing movement during the chamber filling movement phase. The plurality of process parameters include at least one casting chamber geometry parameter, at least one filling amount parameter, at least one casting mold parameter and/or at least one casting chamber temperature or molten material temperature parameter.

11 Claims, 3 Drawing Sheets

(51) Int. Cl.
*B22D 17/10* (2006.01)
*B22D 17/20* (2006.01)

(56) References Cited

U.S. PATENT DOCUMENTS

| | | | |
|---|---|---|---|
| 5,375,646 | A | 12/1994 | Stummer et al. |
| 5,455,773 | A | 10/1995 | Frey |
| 7,349,747 | B2 | 3/2008 | Saito et al. |
| 7,726,381 | B2 | 6/2010 | Taniguchi |

FOREIGN PATENT DOCUMENTS

| | | | |
|---|---|---|---|
| DE | 41 23 463 | A1 | 1/1993 |
| DE | 35 18 635 | C2 | 11/1994 |
| DE | 44 34 654 | A1 | 4/1996 |
| DE | 203 03 812 | U1 | 5/2003 |
| DE | 60 2005 002 875 | T2 | 12/2008 |
| EP | 0 618 026 | A1 | 10/1994 |
| JP | 56-131062 | A | 10/1981 |
| JP | 60-124455 | A | 7/1985 |
| JP | 9-99355 | A | 4/1997 |
| JP | 2002-283034 | A | 10/2002 |
| JP | 2003-245768 | A | 9/2003 |
| JP | 2011-206788 | A | 10/2011 |
| RU | 2 026 144 | C1 | 1/1995 |
| RU | 2 252 108 | C2 | 2/2004 |

* cited by examiner

Fig. 3
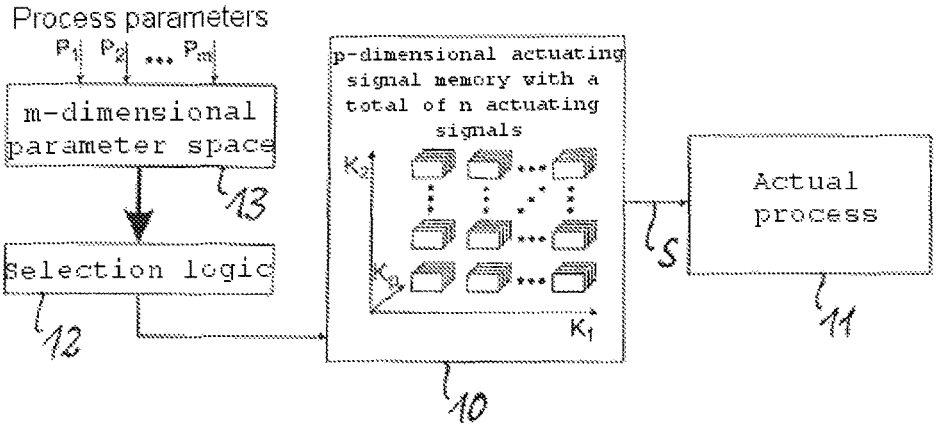
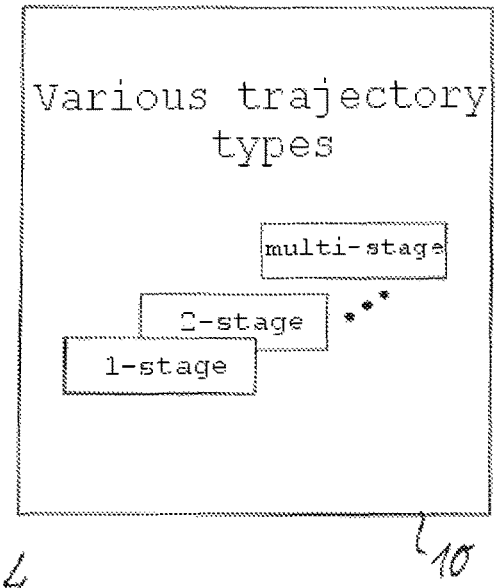
Fig. 4

CONTROL DEVICE FOR THE ADVANCING MOTION OF A CASTING PLUNGER

BACKGROUND AND SUMMARY OF THE INVENTION

The invention relates to a device for controlling the advancing movement of a casting plunger in a casting chamber of a cold-chamber die casting machine by means of an actuating signal. The invention is specifically concerned with the control of the advancing movement of the casting plunger during a time period referred to in the present case as the chamber filling movement phase from a partial filling position of the casting plunger, with a partially filled casting chamber starting volume, to a full filling position of the casting plunger, with a filled casting chamber remaining volume.

As is known, in cold-chamber die casting a molten material to be cast, for example a molten metal alloy substantially comprising aluminum and/or magnesium and/or zinc, is introduced into a horizontally arranged casting chamber and is subsequently transported into a casting mold by a casting plunger driven hydraulically or in some other way. This operation is performed cyclically for the purpose of the multiple production of identical products, molten material being forced into the casting mold each time in every casting cycle. Cylindrical casting chambers with a circular cross section are used almost exclusively for this. The introduction of the molten material into the casting chamber may be performed in various ways, under atmospheric pressure, under positive pressure or under negative pressure, for example by filling via a filling opening of the casting chamber by means of a casting ladle or by suction intake by means of generating a negative pressure in the casting chamber. The amount of molten material introduced into the casting chamber depends on the respective casting mold volume, i.e. the volume of the part to be cast, so that, depending on the cast part, different filling levels in the casting chamber apply and, after the introduction of the molten material, a certain volume of air lying above remains in the horizontally arranged casting chamber cylinder as long as the casting plunger is still in an initial position on a rear side, facing away from the casting mold, of the casting chamber cylinder behind a casting chamber inlet. The term volume of air in the present case also comprises generally the case where it is an upper partial volume of the casting chamber that is filled with a different gas or evacuated.

In a first phase of the advancing movement of the casting plunger, the casting plunger is moved forward from its initial position, in which, as explained, the casting chamber is partially filled, to the full filling position, in which the casting chamber volume successively reduced by the advancing movement of the casting plunger is just completely filled with the filled molten material. This is followed by the injection operation (which is of no further interest in the present case), by which the molten material is forced out of the casting chamber via a casting chamber outlet, facing the casting mold, on a front side of the casting chamber cylinder and the adjoining runner, as it is known, into the casting mold. During the initial chamber filling movement phase, there is the problem of undesired air/gas inclusions in the molten material if the plunger advancing movement progresses unfavorably. Such air/gas inclusions in the molten material may lead to increased porosity and, depending on the use or further processing of the cast part, consequently to unsatisfactory quality of the cast part.

Two effects are responsible for this in particular, as depicted in FIG. 1 and FIG. 2, for purposes of illustration in three part-images respectively, with a casting plunger 2 successively advanced in a horizontally arranged casting chamber cylinder 1, the casting chamber 1 initially being partially filled with a molten material 3, as shown by the respectively uppermost part-image, and the casting plunger 2 being located on a rear side 1*a*, facing away from the casting mold, of the casting chamber 1 behind a casting chamber inlet 4. FIG. 1 shows the creation of a wave breaker 5, i.e. a breaking wave, of the molten material 3 forced forward by the casting plunger 2 in the casting chamber 1, i.e. in the direction of a front side 1*b*, facing the casting mold, of the casting chamber 1. FIG. 2 depicts the effect of a premature brief separation of the wave from the casting plunger 2 and/or premature wave reflection at a front end 1*c*, facing the casting mold, of the casting chamber 1, i.e. with this unfavorable control of the plunger advancing movement a wave of molten material 6 begins to creep forward away from the plunger 2. If this wave 6 reaches the top of the casting chamber directly or else after reflection, it cuts off a volume of air/gas 7 at the casting plunger 2 from a casting chamber outlet 8 lying at the front, as shown in the lower part-image of FIG. 2. Both effects lead to increased air/gas inclusions, as schematically symbolized as small bubbles 9 in the lowermost part-image of FIG. 1 for the case of the wave breaking.

It is an object of the invention to provide a device of the type mentioned at the outset with which the advancing movement of the casting plunger can be controlled, specifically in the chamber filling movement phase, in such a way that the amount of air/gas inclusions in the molten material can be reduced or minimized, which typically leads to reduced porosity in the finished cast part.

The invention solves this problem by providing a control device in which a respective associated progression of the actuating signal is provided for different specified sets of values of a plurality of process parameters that influence the movement of the molten material in the casting chamber during the chamber filling movement phase, which progression is defined as the most suitable actuating signal progression for the particular set of parameter values. The control device is designed to use the most suitable actuating signal progression in dependence on values of the process parameters pertaining at the beginning of a casting cycle for controlling the casting plunger advancing movement during the chamber filling movement phase, the plurality of process parameters including at least one of a group of parameters, said group of parameters comprising at least one casting chamber geometry parameter, at least one filling amount parameter, at least one casting mold parameter, at least one casting chamber temperature, and at least one molten material temperature parameter.

In the control device according to the invention, a respective associated progression of an actuating signal is provided for different specified sets of values of a plurality of process parameters that influence the movement of the molten material in the casting chamber during the chamber filling movement phase, also referred to in the present case as parameters for short, and is used by said device to control the advancing movement of the casting plunger during the chamber filling movement phase from an initial partial filling position, with a partially filled casting chamber starting volume, to the full filling position, with a filled casting chamber remaining volume. The actuating signal progressions provided are in this case progressions for which it is defined that in each case one of them is the most suitable for the particular set of parameter values. "Most suitable" should be understood here as meaning that the actuating signal progression assigned to the particular set of parameter values leads to that progression of the plunger advancing movement that reduces or avoids the undesired effects mentioned, of wave breaking and of cutting off a volume of air, better in the current situation described by the particular set of parameter values than all the other progressions of the plunger advancing movement considered. Apart from this primary quality criterion, the definition as "most suitable" is of course also arrived at by taking into account customary criteria relevant to the casting process, such as the smallest possible time requirement for the casting cycle, and consequently for the plunger advancing movement. The choice of this most suitable actuating signal progression consequently allows the introduction of air/gas into the molten material, and consequently the porosity in the cast part, to be kept as low as possible for each casting cycle, without appreciably slowing down the casting cycle as compared with conventional casting process controls.

The control device according to the invention is correspondingly designed to use this most suitable actuating signal progression in dependence on values of the process parameters pertaining at the beginning of a casting cycle. For this purpose, it may preferably be provided that the possible most suitable actuating signal progressions for various specified sets of values of the parameters taken into account are determined in advance, i.e. before the running time of the casting process or casting cycle, and are stored in the control device. The control device then selects for each casting cycle the actuating signal progression most suitable for the current set of parameter values for controlling the advancing movement of the casting plunger during the chamber filling movement phase. This determination in advance of various progressions of the plunger advancing movement, i.e. different progressions of the relevant actuating signal, may be performed empirically on the actual object or preferably systematically, and consequently deterministically, on the basis of corresponding computer simulations with suitable computational models. The latter makes it possible to carry out a comparatively large number of "tests" with varying values of the relevant process parameters. If the simulation is carried out before the running time of the casting process, the computing time is not restricted to the typical duration of a casting cycle, which allows the use of a relatively computationally intensive model that describes the flow conditions of the molten material in the casting chamber during the plunger advancing movement comparatively well. The simulated model system may also be in particular a simulated closed-loop control system with a closed-loop controller, which attempts to correct computationally established deviations from a desired molten material flow characteristic by corresponding controller interventions. In this way, the most suitable actuating signal progression for the respective starting situation, as described by the currently used set of parameter values, can be determined very accurately by means of model-aided closed-loop control simulation. Alternatively, a direct determination of the actuating signal progression provided may be provided during the running time of the casting process.

The plurality of process parameters influencing the movement of the molten material in the casting chamber during the chamber filling movement phase comprise at least one parameter concerning the casting chamber geometry, at least one parameter concerning the filling amount of molten material in the casting chamber, at least one parameter concerning the casting mold and/or at least one parameter concerning the temperature of the casting chamber and/or the molten material. It is found that, by taking one or more of these parameters into account, it is already possible to obtain usable actuating signal progressions for the plunger advancing movement that to the greatest extent avoid the undesired effects with respect to wave breaking or premature wave separation/wave reflection. Depending on the application, one or more further parameters may be taken into account. Each parameter should be understood here as meaning that, depending on the application, it may comprise current values and/or values originating from one or more previous casting cycles and/or values determined from such values in combination, it being possible in each case for these to be values obtained by measuring instruments or computationally.

In a development of the invention, the plurality of process parameters comprise more specifically at least one casting chamber length parameter, at least one casting chamber height parameter, at least one casting chamber filling degree parameter, at least one molten material temperature parameter, at least one casting chamber temperature parameter and/or at least one molten material viscosity parameter and, depending on the application, optionally one or more further parameters. The geometry parameters describe the spatial boundary conditions for the movement of the molten material in the casting chamber, the temperature/viscosity parameters describe the flow behavior of the molten material and possibly also any outer layer problems, such as that known as skin hardening of the molten material on the casting chamber inner wall.

In an advantageous development of the invention, the actuating signal progressions provided are grouped into a plurality of types with a differing number of successive stages of the progression, each stage representing an associated rise in the height of the molten material at the casting plunger. It is found here that, for example depending on the filling amount of molten material, and consequently the degree of filling of the casting chamber, a single-stage or multi-stage actuating signal progression is favorable, each stage comprising initially raising the filling level of the molten material at the plunger more rapidly by a specifiable degree and then keeping it substantially constant, or at most changing it more slowly. The grouping of all the possible actuating signal progressions in a discrete set of progressions with a differing number of stages also has advantages with regard to the memory space requirement for storing most suitable actuating signal progressions determined in advance, with regard to rapid access to the stored data for the selection of the respectively most suitable actuating signal progression and with regard to the correspondingly staged advancing velocity of the casting plunger.

In a further refinement of this aspect of the invention, each stage of the progression is defined such that it specifies an initially accelerated casting plunger movement followed by a casting plunger movement with a velocity progression that is determined from a progression determined in advance for a height of the molten material at the casting plunger. Typically, this further progression determined in advance for the height of the molten material at the casting plunger comprises that, after it has been raised relatively rapidly to a higher level by the initial accelerated plunger advancing movement, the height of the molten material is subsequently kept substantially at this new level, or at most is raised further significantly more slowly. It is found that this linking of the plunger advancing movement to a specific progression over time of the height of the molten material at the casting plunger can lead to very good most suitable actuating signal progressions for the plunger advancing movement. Moreover, this offers the optional possibility of also intervening in a controlling manner in the operation of the plunger advancing movement by continuously establishing the height of the molten material at the casting plunger by means of sensors.

In a development of the invention, the actuating signal progressions provided are obtained by a model-aided closed-loop control simulation system before or alternatively during a running time of the advancing movement of the casting plunger, with the advantages indicated above in this respect. A determination in advance allows the use of greater computer capacities, and consequently more accurate computational models. An alternative determination directly at the running time allows any current disturbing influences there may be still to be taken into account during the respective casting cycle.

In a further refinement of this aspect of the invention, the model-aided simulation closed-loop control system is integrated in the control device. As a result, it is located at the place of use of the control device, i.e. typically at the location of the associated casting machine, which is favorable in particular for the cases where a determination of the most suitable actuating signal progression directly at the running time of the casting process is provided, or it is intended to enable the casting machine user to determine most suitable actuating signal progressions itself in advance by model-aided closed-loop control simulation for the particular casting machine system.

BRIEF DESCRIPTION OF THE DRAWINGS

Advantageous embodiments of the invention and the conventional examples explained above for better understanding thereof are represented in the drawings, in which:

FIG. 3 shows a block diagram of a control device according to the invention, FIG. 4 shows a block diagram of an advantageous way of realizing an actuating signal type memory of the control device from FIG. 3

DETAILED DESCRIPTION OF THE DRAWINGS

Advantageous embodiments of the invention are explained in more detail below with reference to the corresponding figures.

Figure 1:
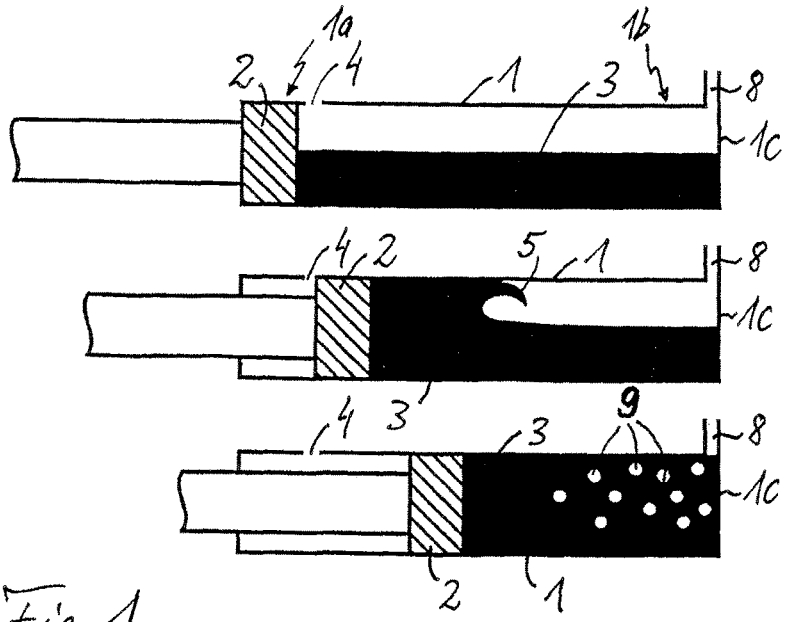
FIG. 1 shows schematic longitudinal sectional views of a casting chamber of a cold-chamber die casting machine in three successive advancing positions of a conventionally controlled casting plunger, a wave breaker occurring.
Figure 2:
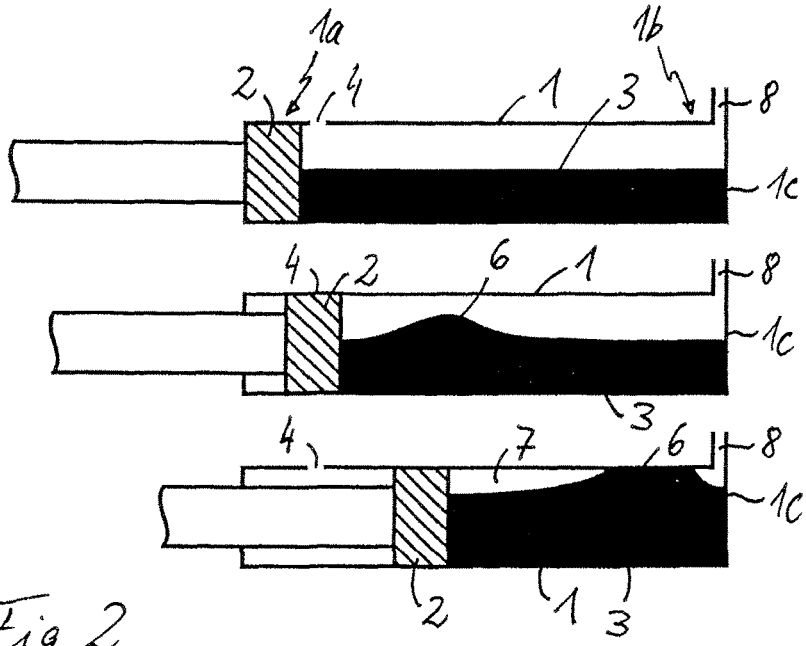
FIG. 2 shows three schematic longitudinal sectional views corresponding to FIG. 1 for a case of a conventional advancing control of the casting plunger, in which a premature wave separation and/or a wave reflection occurs.

The control device depicted in FIG. 3 in the form of a block diagram serves for controlling the advancing movement of a casting plunger of a casting unit of a conventional type of construction for a cold-chamber die casting machine. Such a conventional casting unit comprises a typically cylindrical casting chamber with a circular cross section, which is arranged in the casting machine with a horizontal longitudinal axis of the cylinder. The casting chamber and the casting plunger may in particular be of the type of construction such as that explained above in relation to FIGS. 1 and 2. In the case of this type of construction, the upper-lying filling opening 4, i.e. the casting chamber inlet, via which for example the molten material 3 is filled into the casting chamber 1 in a specified metered amount by means of a casting ladle, is located on the rear side of the casting chamber 1*a*. In the same way, the invention is also suitable for alternative types of construction of the casting unit, in which the molten material is sucked into the casting chamber by means of negative pressure or forced into the casting chamber by means of positive pressure. On its front side 1*b*, the casting chamber 1 has in its upper region the casting chamber outlet 8. In the injection operation, the molten material 3 is forced by the forward movement of the casting plunger 2 via the chamber outlet 8 and the adjoining runner into the casting mold, in order to form the cast part there. In this case, the chamber filling movement phase explained above forms a first phase of this plunger movement, up to the point in time at which the remaining volume of the casting chamber 1 that is successively reduced by the moved-forward casting plunger 2 just corresponds substantially to the volume of filled-in molten material 3, i.e. at which the remaining volume of the casting chamber is completely filled with the molten material 3 and the volume of air/gas previously additionally contained in the casting chamber 1 has been removed almost completely from the casting chamber 1 via the casting chamber outlet 8, the runner and the venting openings provided for this in the casting mold. As already mentioned, the invention specifically comprises a characteristic design of the control device for the plunger advancing movement in this initial chamber filling movement phase. The control device may otherwise be realized in any desired suitable way, as known per se for casting plunger control in cold-chamber die casting machines.

As represented in FIG. 3, the control device has a data memory 10, in which a plurality of possible actuating signal progressions are stored. The control device uses one of these actuating signal progressions for the respective casting cycle and thereby controls the plunger advancing movement, in particular in said chamber filling movement phase. This casting cycle is symbolized in FIG. 3 as an actual process 11, which is controlled by the selected actuating signal S.

The control device selects the actuating signal S as a most suitable actuating signal for the respectively upcoming casting cycle according to specified criteria. For this purpose, a corresponding selection logic 12 is implemented in it. Via an input stage 13 of the control device, the selection logic 12 is fed for the respective casting cycle a set of values of a number m of specifiable process parameters $P_1, \ldots, P_m$, which describes the initial conditions of the upcoming casting cycle, insofar as these are relevant for the achievement of a desired progression, detected as favorable, of the plunger advancing movement in the chamber filling movement phase. In particular, this desired, optimized control of the plunger advancement in this phase comprises avoidance, at least to a great extent, of the effects explained above as unfavorable of the molten material flow dynamics in the casting chamber that lead to increased air/gas inclusions in the molten material, such as in particular the effects illustrated in FIGS. 1 and 2 of a wave breaker and a premature wave separation or cutting off of a volume of air/gas on the plunger side.

The process parameters $P_i$ (i=1, . . . , m) respectively taken into account as relevant are defined in a form adapted to the respective application and comprise at least one casting chamber geometry parameter, at least one filling amount parameter, at least one casting mold parameter and/or at least one casting chamber temperature or molten material temperature parameter. Typical casting chamber geometry parameters are, for example, the casting chamber length and the casting chamber height. With the at least one filling amount parameter it is described in what proportion the casting chamber volume is initially filled with the molten material. In actual fact, this may for example be an initial filling height, a degree of filling as a ratio of the initial filling height to the maximum possible filling height, i.e. the casting chamber diameter, or the established weight or volume of molten material introduced into the casting chamber. With the at least one casting mold parameter, the influence of the casting mold can be described, in particular its minimum or maximum mold venting time, by which it is defined how long the operation of air/gas displacement in the casting chamber should or may last as a minimum or as a maximum. The temperature and/or viscosity parameters describe the flow behavior of the molten material and possibly also outer layer effects, such as skin hardening or partial solidification of molten material on the casting chamber inner wall or else in the interior of the molten material.

Each of such parameters may, according to requirements, comprise current values and/or values originating from one or more previous casting cycles and/or combinations of such current and/or earlier values. The individual parameter values may be measured values and/or calculated or estimated values. Thus, for example, the at least one filling amount parameter may be an estimated value for the current degree of filling and/or one or more measured or calculated actual values for the degree of filling from past casting cycles. It is thus possible at the running time of the respective casting cycle for the current initial state, insofar as it is relevant to the plunger advancing movement considered here, to be described sufficiently accurately, according to the current state of the machine and the history thereof, as an m-dimensional parameter space and to be fed as input information via the input stage 13 to the selection logic 12.

For the provision of the actuating signal progressions most suitable for different starting situations, as are stored in the memory 10 in the case of the exemplary embodiment from FIG. 3, there are several possibilities, which are discussed in more detail below.

In principle, the two alternatives of providing the actuating signal to be used for the current casting cycle for plunger movement control before or during the running time of the casting process come into consideration. In the text that follows, an implementation for providing it before the running time is explained first. In an advantageous way of realizing this, the obtainment of the most suitable actuating signal progressions, as are then stored in the actuating signal memory 10, takes place by model-aided computer simulation before the process running time. This computer simulation includes a model control circuit, which comprises a simple computational model for the pre-control determination and a highly accurate computational model for the actual process and also a model controller. Although precontrol in its pure form, on the basis of a simple computational model without a controller, also comes into consideration as an alternative to such a model control circuit, the addition of the controller makes it possible to achieve a greater accuracy or better approximation of the actual process and the use of a relatively simple model for the precontrol. The model controller supplements the control signal supplied by the precontrol to form the actuating signal for the highly accurate computational model in dependence on a deviation of a setpoint progression, supplied by the precontrol, and an actual progression, supplied by the highly accurate computational model, of one or more process variables used for this. The most suitable actuating signals obtained for the various initial conditions considered, represented by the process parameters mentioned, as obtained from this model-aided closed-loop control simulation, are then, as stated, stored in the memory 10 and are available to the control device at the running time of the casting process.

As already mentioned above, a most suitable actuating signal progression is understood as meaning an actuating signal progression by which the plunger advancing movement controlled thereby in the chamber filling movement phase leads to a casting operation that is favorable according to specified quality criteria, and in particular to a behavior of the molten material flow in the casting chamber in which the aforementioned effects of a wave breaker and air/gas being cut off on account of premature wave separation and/or wave reflection are avoided entirely, or at least for the most part, while on the other hand the casting cycle, and consequently also the plunger advancing movement, are intended to proceed as quickly as possible. Suitable modified shallow water equations for describing the molten material flow dynamics in the casting chamber come into consideration as a basis for the simple model for the precontrol design, with fluid reflections at the front end of the casting chamber being taken into account, and furthermore, in good approximation, also the usually circular cross section of the casting chamber. The top of the casting chamber may also be included in the precontrol design as a height restriction for the movement of the molten material, and similarly, if need be, the position of the filling opening of the casting chamber, in order to avoid with certainty any escape of molten material there at the beginning of the casting plunger movement.

Since, in the variant being considered here, the simulation is performed before the process running time, the simulation calculation is not subject to the direct time restriction of the actual casting cycle. This allows the use of a comparatively accurate computational model, whereby the quality of the most suitable actuating signal progressions determined in advance for the actual process can be increased significantly.

Consequently, this simulation allows very accurate most suitable actuating signal progressions to be determined before the running time by using a model control circuit, progressions which can then be used for the actual process in the course of purely open-loop control. Genuine closed-loop control of the actual process is alternatively possible in principle, but is usually ruled out in practice for the process being considered here comprising the advancing movement of the casting plunger, if only for example because the obtainment and return of the actual values of the controlled variables necessary for this is not possible sufficiently quickly or is too complex. This applies in particular to machines of a smaller type, which have such short casting cycle times that it is not practicable from a present-day perspective for the required measured values to be established and utilized in a control system.

An alternative possibility provides a corresponding model-aided closed-loop control simulation at the running time of the casting process, the actuating signal obtained by the simulation then being used directly for controlling the plunger advancing movement in the actual process, which dispenses with the need for the actuating signal memory. In order to make the simulation possible at the running time, the simple model for the precontrol and the highly accurate computational model replicating the actual process must be suitably chosen, so that the simulation calculations can proceed sufficiently quickly. As compared with a simulation before the running time, this means the use of greater computing capacities and/or the use of a simpler computational model, or altogether a simpler closed-loop control model.

As mentioned, the exemplary embodiment from FIG. 3 relates to the variant of an embodiment in which a multiplicity n of most suitable actuating signals for a possibly also relatively large number of sets of the process parameters $P_1, \ldots, P_m$ taken into account have been determined in advance, for example by the model-aided closed-loop control simulation mentioned, and then stored in the memory 10. As becomes clear from the above explanations of the process parameters $P_1, \ldots, P_m$, there are in a correspondingly m-dimensional parameter space such sets of process parameters even for the case where a specific identical cast part is produced in many successive casting cycles, since, depending on the process, at least some of these process parameters may vary from casting cycle to casting cycle. On the basis of corresponding criteria, the selection logic 12 can determine for each casting cycle a number p of selection coordinates $K_1, \ldots, K_p$, for the combinations of which the associated most suitable actuating signals are individually generated in advance in corresponding simulation operations. The actuating signal memory 10 then comprises a p-dimensional selection coordinate space for the multiplicity n of most suitable actuating signal progressions, as depicted in FIG. 3, the number p being less than or equal to the number m. In this case, it may be expedient to map as many of the parameters $P_1, \ldots, P_m$ as possible onto the fewest possible selection coordinates $K_1, \ldots, K_p$, in order to keep the number n of possible actuating signal progressions as small as possible for reasons of the storage requirement and/or the preceding computational effort.

It should be mentioned at this point that, in particular in the case of a simulation before the running time of the casting process performed by using a comparatively highly accurate computational model and a simulation tool of a high computational power, it is possible to take into account almost all of the essential parameters that are relevant to the actual process of the plunger advancing movement during the chamber filling movement phase, in particular even viscous and thermal effects such as viscosity variation and partial solidification. If need be, a three-dimensional velocity field can be used here for describing the molten material flow dynamics in the casting chamber that takes the circular cross section of the casting chamber and vertical flows almost completely into account.

Investigations undertaken by the inventors have shown that the unfavorable effects mentioned, of a wave breaker and cutting off a volume of air/gas on the plunger side, can be reduced or avoided in particular by a progression of the plunger advancing movement that results in a staged raising of the molten material filling height on the plunger side in the casting chamber. These results make it possible to group the multiplicity n of determined most suitable actuating signals in the p-dimensional space of the selection coordinates $K_1, \ldots, K_p$ into groups of actuating signal progressions, also referred to in the present case as actuating signal trajectory types, with a differing number of such excitation stages. This simplifies the structure of the actuating signal progression data to be stored in the memory 10 and improves or speeds up the selection of the respectively most suitable actuating signal progression by the selection logic 12 on the basis of the input parameters $P_1, \ldots, P_m$.

For this purpose, for each set of the process parameters $P_1, \ldots, P_m$ it is established in the pre-determination of the most suitable actuating signal progressions which type of trajectory is most suitable, i.e. with which number of such excitation stages the plunger advancing movement should be controlled in this situation in order to achieve the desired best possible result. Correspondingly, this information is stored in the memory 10, see FIG. 4. During the casting process, the selection logic 12 then decides on the basis of the fed process parameter input information according to which stage type of the actuating signal progression the plunger advancing movement should take place in the current casting cycle.

Each of these said excitation stages represents a corresponding part of the plunger advancing movement, in which the plunger is initially moved forward relatively quickly, in order to raise the molten material filling height at the plunger from a previous level to a specifiable higher level. After that, a velocity progression, which is determined from a progression determined in advance of the height of the molten material at the casting plunger, is specified for the advancement of the plunger, this progression determined in advance typically comprising that the molten material filling height at the plunger is kept substantially constant, or at most is raised relatively slowly over time. The number of stages to be used varies, for example depending on the degree of filling. In the case of a lower initial molten material filling level in the chamber, a plunger advancing movement with more stages is chosen than in the case of higher degrees of filling.

Figure 5:
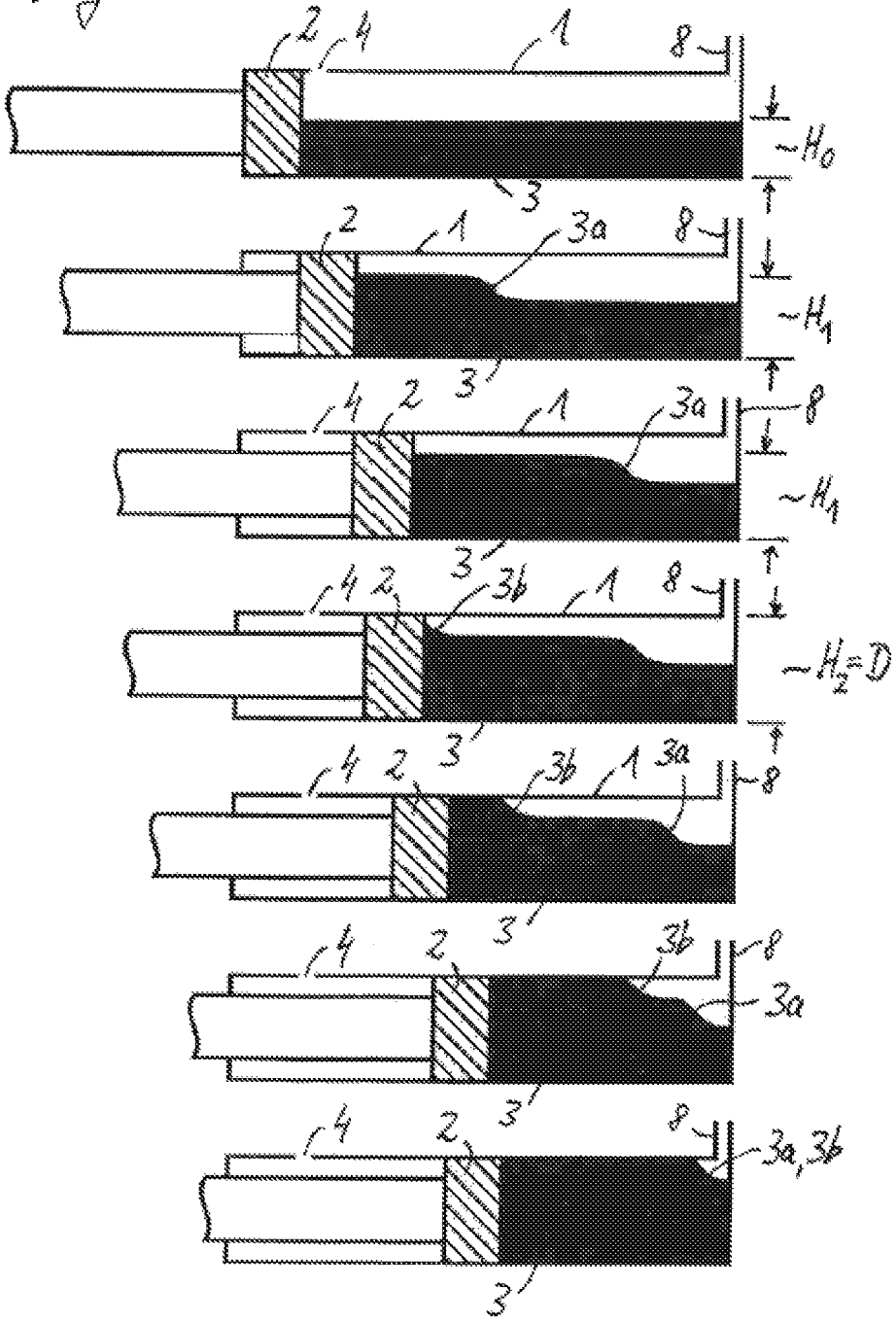
FIG. 5 shows schematic longitudinal sectional views of a casting chamber of a cold-chamber die casting machine in successive advancing positions of a casting plunger moved forward by the control device according to the invention.

FIG. 5 depicts an example with a two-stage excitation. The example from FIG. 5 is depicted on the basis of the casting chamber 1 and the casting plunger 2, as they have been explained in FIGS. 1 and 2 and the above description thereof, to which reference can be made here. In the example from FIG. 5, initially, before the plunger advancing movement commences, the molten material 3 assumes a height $H_0$ in the casting chamber 1, see the uppermost part-image. Starting from there, the plunger 2 is initially moved forward in an accelerated manner, in order to generate a first stage 3*a* of wave excitation of the liquid molten material 3, by which the molten material filling height at the plunger 2 is raised from the initial height $H_0$ to a suitably specified greater height $H_1$. Subsequently, the plunger 2 is moved forward with reduced acceleration or at a substantially constant velocity in such a way that the molten material filling height at the plunger 2 remains substantially at the height level $H_1$ of the first stage 3*a*, the corresponding wave excitation being propagated in the forward direction, as can be seen from the second- and third-uppermost part-images of FIG. 5.

After a specified time period, a second stage 3*b* is generated for the wave excitation of the molten material 3 in the chamber 1 by corresponding control of the plunger advancement. For this purpose, the plunger 2 is in turn moved initially with greater acceleration, until the molten material filling level at the plunger 2 has reached a specified, new, higher level $H_2$. In the example shown of the choice of a two-stage actuating signal progression, this new height $H_2$ corresponds to the total height of the chamber, i.e. the diameter D of the casting chamber 1, see the middle part-image in FIG. 5. Subsequently, the plunger 2 is then moved forward again with lower acceleration or at a substantially constant velocity in such a way that the molten material 3 at the plunger 2 substantially maintains the new height level $H_2$, the second wave excitation stage 3*b* being propagated in the forward direction, see the third-lowermost part-image in FIG. 5.

In the final excitation stage, in the example from FIG. 5 the second stage, the volume of air/gas that still remains in the chamber 1 between the molten material 3 and the top of the chamber on the plunger side is consequently displaced from the plunger side in the direction of the end of the casting chamber, i.e. the casting chamber outlet 8. By suitable coordination of the individual excitation stages, as can be determined for example by the mentioned model-aided closed-loop control simulation before the running time of the casting process, it can be achieved that the individual excited wave stages, in the example from FIG. 5 the two stages 3*a* and 3*b*, meet or come together at the end of the casting chamber, and in this way an almost complete displacement of the volume of air/gas from the casting chamber 1 is brought about, as depicted in the second-lowermost and lowermost part-images of FIG. 5. The determination of the associated most suitable actuating signal progressions is possible here in advance in a completely systematic manner, since it can be determined computationally at what velocity the individual wave excitation stages progress in dependence on their respective height in the casting chamber.

A major influencing factor that can lead to increased air/gas inclusions in the molten material 3 is a metering inaccuracy occurring in practice, for example an error in the volume of the molten material 3 introduced into the chamber 1 of ±5%. To take this factor into account, the staged raising of the height of the molten material on the plunger side takes place in such a way that, even with the maximum specified metering error, the height of the molten material on the plunger side remain safely below the top of the casting chamber in all stages with the exception of the final stage. The final stage is relatively insensitive to metering inaccuracies. This is so because an error in height of the penultimate stage is all the more uncritical with regard to the plunger velocity to be specified by the control the closer this penultimate stage height is to the top of the casting chamber. The staging is therefore chosen such that the height of the molten material on the plunger side in the penultimate stage on the one hand maintains a specifiable minimum distance from the top of the casting chamber even with the maximum over-metering, and on the other hand does not exceed a specifiable maximum distance from the top of the casting chamber even with the maximum under-metering, so that the desired complete displacement of air/gas from the plunger side is just achieved by the final wave excitation stage. With this staged control of the plunger advancing movement, the top of the chamber of the casting chamber cylinder can consequently be included systematically in the determination of the respectively most suitable actuating signal progression, and at the same time a sufficient robustness with respect to metering errors can be ensured.

It goes without saying that, apart from the two-stage control that is shown in FIG. 5, a single-stage control or more than two-stage control of the plunger advancing movement may also be provided, depending on the initial values pertaining for the process parameters $P_1, \ldots, P_m$ regarded as relevant to influencing. Apart from the mentioned inclusion of metering errors, the viscosity properties of the molten material and thermal effects within the casting chamber, such as a partial solidification, in which solidified components on the molten material affect the wave propagation, may also be systematically included in the determination of the respectively most suitable actuating signal progression for the plunger advancing movement.

In the cases described, in which the most suitable actuating signal progressions are determined by a model-aided closed-loop control simulation system, this model-aided simulation closed-loop control system may be integrated in the control device, which is typically located at the place of use of the casting machine. The control device according to the invention may for its part be integrated in a central machine control of the die casting machine. Alternatively, the model-aided closed-loop control simulation system may be implemented outside the control device according to the invention, the most suitable actuating signal progressions that are supplied by the model-aided closed-loop control simulation system then being fed to or provided for the control device, for example as mentioned by being stored in an actuating signal memory of the control device.

The invention claimed is:

1. A device for a cold-chamber die casting machine, comprising:

a control device that controls an advancing movement of a casting plunger in a casting chamber of the cold-chamber die casting machine by way of an actuating signal, the advancing movement comprising a chamber filling movement phase from a partial filling position, with a partially filled casting chamber starting volume, to a full filling position, with a filled casting chamber remaining volume, wherein the control device stores a respective associated progression of the actuating signal for different specified sets of values of a plurality of process parameters that influence movement of the molten material in the casting chamber during the chamber filling movement phase, which progression is defined as the most suitable actuating signal progression for the particular set of parameter values using a quality criterion which includes minimizing wave breaking of the molten material and air/gas inclusion in the molten material present in the casting chamber, and the control device variably controls the casting plunger advancing movement during the chamber filling movement phase based on the most suitable actuating signal progression in dependence on values of the process parameters pertaining at the beginning of a casting cycle, the plurality of process parameters including at least one of a group of parameters, said group of parameters comprising at least one casting chamber geometry parameter, at least one filling amount parameter, at least one casting mold parameter, at least one casting chamber temperature, and at least one molten material temperature parameter.

2. The device as claimed in claim 1, wherein said group of parameters further comprise at least one casting chamber length parameter, at least one casting chamber height parameter, at least one casting chamber filling degree parameter, at least one molten material temperature parameter, at least one casting chamber temperature parameter, and at least one molten material viscosity parameter.

3. The device as claimed in claim 2, wherein the actuating signal progressions provided are obtained by a model-aided closed-loop control simulation system before or during a running time of the advancing movement of the casting plunger.

4. The device as claimed in claim 1, wherein the actuating signal progressions provided are obtained by a model-aided closed-loop control simulation system before or during a running time of the advancing movement of the casting plunger.

5. The device as claimed in claim 4, further including the model-aided simulation closed-loop control circuit system.

6. A device for a cold-chamber die casting machine, comprising:

a control device that controls an advancing movement of a casting plunger in a casting chamber of the cold-chamber die casting machine by way of an actuating signal, the advancing movement comprising a chamber filling movement phase from a partial filling position, with a partially filled casting chamber starting volume, to a full filling position, with a filled casting chamber remaining volume, wherein the control device stores a respective associated progression of the actuating signal for different specified sets of values of a plurality of process parameters that influence movement of the molten material in the casting chamber during the chamber filling movement phase, which progression is defined as the most suitable actuating signal progression for the particular set of parameter values, and the control device controls the casting plunger advancing movement during the chamber filling movement phase based on the most suitable actuating signal progression in dependence on values of the process parameters pertaining at the beginning of a casting cycle, the plurality of process parameters including at least one of a group of parameters, said group of parameters comprising at least one casting chamber geometry parameter, at least one filling amount parameter, at least one casting mold parameter, at least one casting chamber temperature, and at least one molten material temperature parameter, wherein the actuating signal progressions provided are grouped into a plurality of types with a differing number of successive stages of the progression, each stage representing an associated rise in the height of the molten material at the casting plunger.

7. The device as claimed in claim 6, wherein each stage of the progression specifies an initially accelerated casting plunger movement followed by a casting plunger movement with a velocity progression that corresponds to a progression determined in advance for a height of the molten material at the casting plunger.

8. The device as claimed in claim 7, wherein the actuating signal progressions provided are obtained by a model-aided closed-loop control simulation system before or during a running time of the advancing movement of the casting plunger.

9. The device as claimed in claim 6, wherein the actuating signal progressions provided are obtained by a model-aided closed-loop control simulation system before or during a running time of the advancing movement of the casting plunger.

10. The device as claimed in claim 6, wherein said group of parameters further comprise at least one casting chamber length parameter, at least one casting chamber height parameter, at least one casting chamber filling degree parameter, at least one molten material temperature parameter, at least one casting chamber temperature parameter, and at least one molten material viscosity parameter.

11. The device as claimed in claim 10, wherein each stage of the progression specifies an initially accelerated casting plunger movement followed by a casting plunger movement with a velocity progression that corresponds to a progression determined in advance for a height of the molten material at the casting plunger.

* * * * *